US007527330B2

(12) United States Patent
Montpas

(10) Patent No.: US 7,527,330 B2
(45) Date of Patent: May 5, 2009

(54) KIT FOR SECURING A POLE TO A SPORT CHAIR

(76) Inventor: Robert Vincent Montpas, 1837 S. 8th Ave., Monrovia, CA (US) 91016

( * ) Notice: Subject to any disclaimer, the term of this patent is extended or adjusted under 35 U.S.C. 154(b) by 0 days.

(21) Appl. No.: 11/855,002

(22) Filed: Sep. 13, 2007

(65) Prior Publication Data

US 2009/0072597 A1 Mar. 19, 2009

(51) Int. Cl.
*A47C 7/62* (2006.01)
*A45B 3/00* (2006.01)

(52) U.S. Cl. ..... 297/184.15; 297/188.2; 135/16

(58) Field of Classification Search ..... 297/184.16, 297/188.2, 184.15, 188.01, 463.1, 463.2, 297/184.1; 24/20 LS, 19, 17 A; 135/16, 135/98; 16/404; 248/530, 539, 540
See application file for complete search history.

(56) References Cited

U.S. PATENT DOCUMENTS 3,848,838 A * 11/1974 Thomas ..... 248/541
3,904,161 A 9/1975 Scott
4,030,748 A * 6/1977 Brock ..... 297/184.1
D250,300 S 11/1978 Rohr
4,188,965 A * 2/1980 Morman ..... 135/16
4,300,798 A 11/1981 Musgrove et al.
4,789,200 A 12/1988 Munguia
4,871,141 A * 10/1989 Chen ..... 248/534
5,518,218 A * 5/1996 Leonard ..... 248/530
5,641,197 A 6/1997 Springmann
5,749,386 A * 5/1998 Samuel, Jr. ..... 135/16
5,762,308 A * 6/1998 Bryan ..... 248/314
5,787,555 A * 8/1998 Chen ..... 24/274 R
6,105,594 A 8/2000 Diaz
6,244,557 B1 * 6/2001 Maze ..... 248/541
6,698,830 B1 * 3/2004 Gaines ..... 297/188.11
7,201,442 B1 * 4/2007 Decosta, Jr. ..... 297/184.16
7,226,126 B1 * 6/2007 Spanovich ..... 297/184.16
2004/0222678 A1 * 11/2004 Hansen ..... 297/184.1
2007/0236058 A1 * 10/2007 Yeider ..... 297/184.1

* cited by examiner

*Primary Examiner*—Milton Nelson, Jr.

(57) ABSTRACT

The present invention features a fastening system for fastening a pole, e.g. and umbrella pole or a fishing pole, to a sport chair. The system comprises a tubular member, at least one securing member to secure the tubular member to a leg of the sport chair, at least one gripping member to prevent the securing member from sliding on the leg of the chair; and at least one fastening member to pin down the sport chair; and a tightening member to hold in place the umbrella pole or the fishing pole that is inserted in the tubular member.

4 Claims, 2 Drawing Sheets

KIT FOR SECURING A POLE TO A SPORT CHAIR

FIELD OF THE INVENTION

The present invention is directed to a chair fastening system that includes a tubular member, at least one securing member, at least one fastening member, and at least one gripping member to enable a person to attach an outdoor chair to a pole, e.g., an umbrella pole or a fishing pole, while securing the outdoor chair and the pole, e.g., an umbrella pole or a fishing pole, to the ground. The present invention may also be used to secure a fishing pole to a chair and the ground.

BACKGROUND OF THE INVENTION

Persons sitting in an outdoor chair often wish to sit under the shade of an umbrella. They also may wish to have the outdoor chair secured to the ground while simultaneously having the outdoor chair secured to the umbrella. However, a person desiring to sit in the outdoor chair under the shade of an umbrella finds the outdoor chair often is not stable due to uneven ground, and no such fastening system exists to allow the outdoor chair to be secured to the ground while simultaneously having the outdoor chair secured to the umbrella.

Therefore, there is a need for an improved chair fastening system, where a person may secure the outdoor chair to the ground while simultaneously securing the outdoor chair to the umbrella.

SUMMARY OF THE INVENTION

The present invention features a fastening system for fastening an umbrella or fishing pole to a sport chair. The system comprises a tubular member (which is hollow on the inside), at least one securing member to secure the tubular member to a leg of the sport chair, at least one gripping member to prevent the securing member from sliding on the leg of the chair, and at least one fastening member to pin down the sport chair; and a tightening member to hold in place the umbrella pole or fishing pole that is inserted in the tubular member.

DESCRIPTION OF PREFERRED EMBODIMENTS

Figure 1:
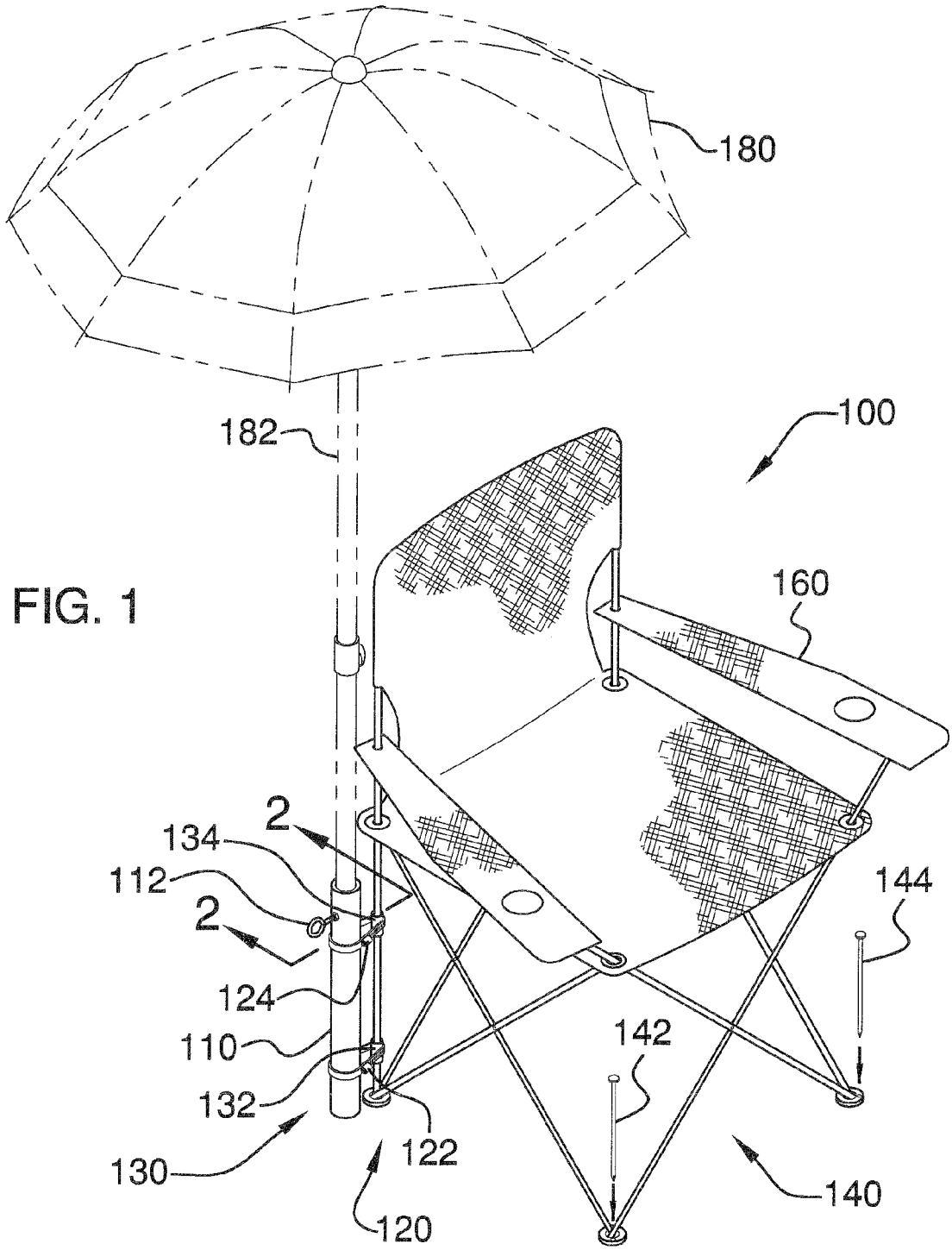
FIG. 1 is an illustration of the chair fastening system as used on an outdoor chair and outdoor umbrella including a tubular member, at least one securing member, at least one gripping member, and at least one fastening member.

Referring now to FIG. 1, fastening system 100 comprises tubular member 110 (which is hollow on the inside) for holding an umbrella pole 182, securing member 120 for securing the tubular member 110 to a leg of a chair, gripping member 130 for preventing the securing member from sliding on the leg of a chair, fastening member 140 for fastening an outdoor chair 160 to the ground. FIG. 1 also shows an umbrella pole

182 holding up and umbrella 180, but as used herein, an umbrella pole is interchangeable with a fishing pole). In the illustrated embodiment of FIG. 1, tubular member 110 comprises tightening device 112, for tightening the pole 182 to the tubular member 110. In the illustrated embodiment of FIG. 1, securing member 120 comprises first securing member 122 and second securing member 124. In the illustrated embodiment of FIG. 1, gripping member 130 comprises first gripping member 132 and second gripping member 134. In the illustrated embodiment of FIG. 1, fastening member 140 comprises first fastening member 142 and second fastening member 144.

Umbrella pole 182 is threaded through tubular member 110. In certain embodiments, umbrella pole 182 is forced into the ground to secure the umbrella 180. In other embodiments, umbrella pole 182 sits within tubular member 110. Tightening device 112 is turned in a first direction to secure tubular member 110 to umbrella pole 182. To loosen umbrella pole 182 from tubular member 110, tightening device 112 is turned in a second and opposite direction. A user of the fastening system 100 will thread at least one leg of outdoor chair 160 through first gripping member 132 and second gripping member 134. First gripping member 132 and second gripping member 134 keep first securing member 122 and second securing member 124 from sliding on the leg of outdoor chair 160. The user may then wrap first securing member 122 and second securing member 124 around tubular member 110 to secure the outdoor chair 160 to umbrella pole 182.

Figure 3:
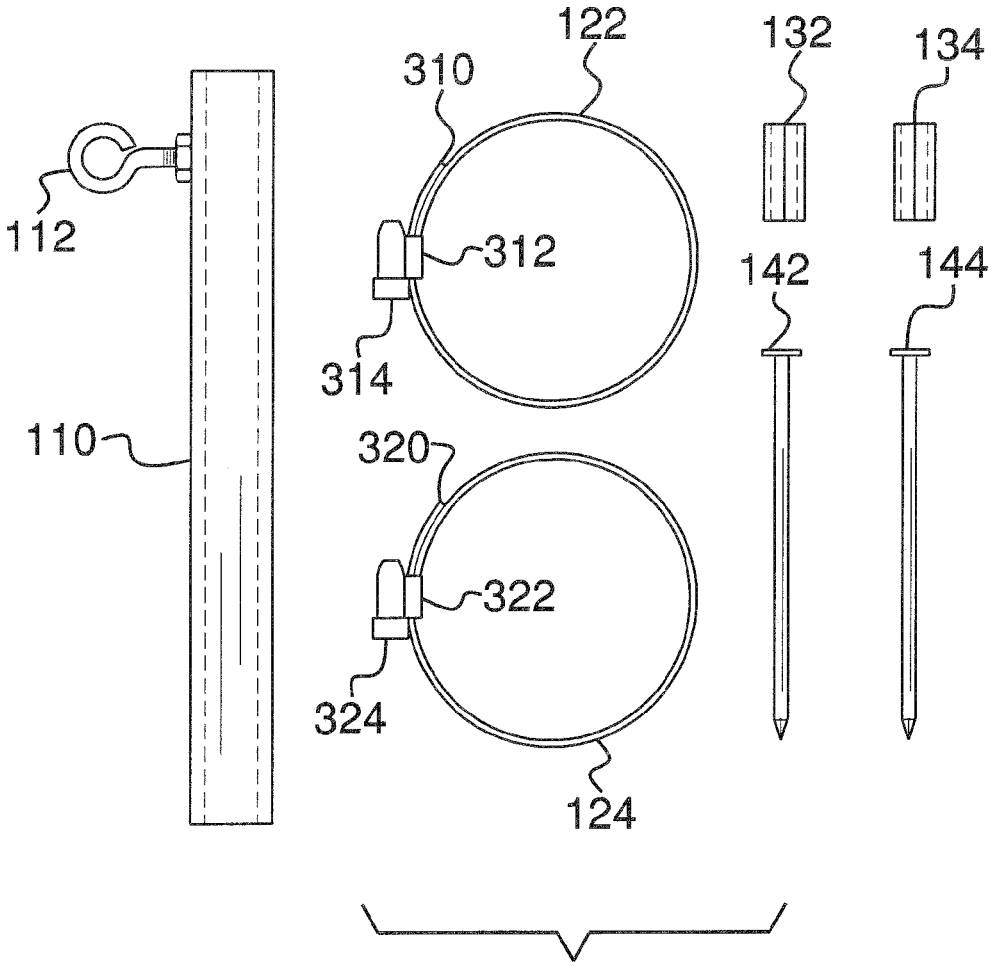
FIG. 3 is an illustration of the chair fastening system according to the invention, including a tubular member, at least one securing member, at least one gripping member, and at least one fastening member.

First securing member 122 comprises first end 310, second end 312, and releasable lock 314 (see FIG. 3). To lock first securing member 122, the user will wrap first securing member 122 into a circular shape where first end 310 meets second end 312. First end 310 will then be pushed into releasable lock 314 and pulled tight to secure the loop. Second securing member 124 comprises first end 320, second end 322, and releasable lock 324 (see FIG. 3). To lock second securing member 124, the user will wrap second securing member 124 into a circular shape where first end 320 meets second end 322. First end 320 will then be pushed into releasable lock 324 and pulled tight to secure the loop. Releasable lock 314 and releasable lock 324 comprise mechanisms that allow the user to loosen first end 310 and first end 320 from within the releasable lock 314 and releasable lock 324, respectively, so the fastening system may be removed from outdoor chair 160 and umbrella pole 182.

The user may then position the legs of outdoor chair 160 in a desired position and fasten the legs using first fastening member 142 and second fastening member 144. First fastening member 142 and second fastening member 144 may be secured to the ground using a downward force from a blunt object known to one skilled in the art. In certain embodiments, fastening system 100 comprises one securing member. In other embodiments, fastening system 100 comprises more than one securing member. In certain embodiments, fastening system 100 comprises one gripping member. In other embodiments, fastening system 100 comprises more than one gripping member. In certain embodiments, fastening system 100 comprises one fastening member. In other embodiments, fastening system 100 comprises more than one fastening member.

In the illustrated embodiment of FIG. 1, tubular member 110 comprises a rigid material selected from the group consisting of metal, an engineering plastic, wood, or combinations thereof. In certain embodiments, tubular member 110 comprises a tubular member having an outside diameter between about ½ inch and about 2½ inches, and an inside diameter between about ⅜ inch and about 2⅜ inches. In certain embodiments, tubular member 110 comprises a tubular member having a length between about 4 inches and about 16 inches.

In the illustrated embodiment of FIG. 1, first securing member 122 comprises a semi-rigid material selected from the group consisting of plastic, rubber, steel, or combinations thereof. In certain embodiments, first securing member 122 comprises a length between about 3 inches and about 11 inches. In certain embodiments, first securing member 122 comprises a thickness between about 1/32 inch and about 1/4 inch. In certain embodiments, first securing member 122 comprises a width between about 1/8 inch and about 2 inches.

In the illustrated embodiment of FIG. 1, second securing member 124 comprises a semi-rigid material selected from the group consisting of plastic, rubber, steel, or combinations thereof. In certain embodiments, second securing member 124 comprises a length between about 3 inches and about 11 inches. In certain embodiments, second securing member 124 comprises a thickness between about 1/32 inch and about 1/4 inch. In certain embodiments, second securing member 124 comprises a width between about 1/8 inch and about 2 inches.

In the illustrated embodiment of FIG. 1, first gripping member 132 comprises a semi-rigid material selected from the group consisting of plastic, rubber, Neoprene, foam, or combinations thereof. In certain embodiments, first gripping member 132 comprises a tubular member having an outside diameter between about 1/2 inch and about 2 inches. In certain embodiments, first gripping member 132 comprises a tubular member having a length between about 1/2 inch and about 2 inches.

In the illustrated embodiment of FIG. 1, second gripping member 134 comprises a semi-rigid material selected from the group consisting of plastic, rubber, Neoprene, foam, or combinations thereof. In certain embodiments, second gripping member 134 comprises a tubular member having an outside diameter between about 1/2 inch and about 2 inches. In certain embodiments, second gripping member 134 comprises tubular member having a length between about 1/2 inch and about 2 inches.

In the illustrated embodiment of FIG. 1, first fastening member 142 comprises a rigid material selected from the group consisting of metal, an engineering plastic, wood, or combinations thereof. In the illustrated embodiment of FIG. 1, first fastening member 142 comprises a standard nail known by one skilled in the art. In some embodiments, the nail has a hook on the end. 5 inches and about 12 inches in length.

Figure 2:
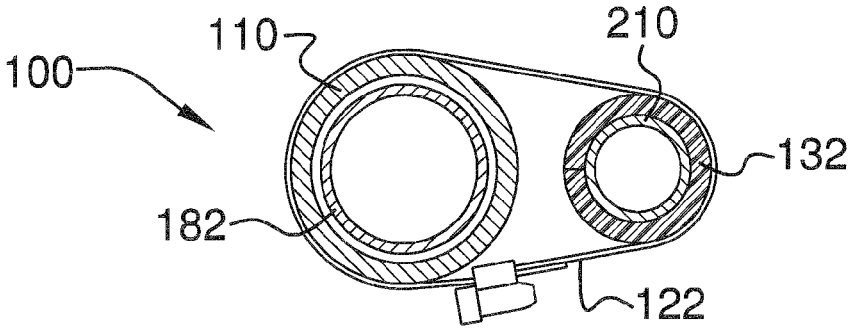
FIG. 2 is a top view illustration of a cross-section of the chair fastening system according to the invention, including a tubular member, at least one securing member, and at least one gripping member.

Referring now to FIG. 2, a top cross-sectional view of fastening system 100 is shown comprising tubular member 110, first securing member 122, first gripping member 132, umbrella pole 182, and outdoor chair leg 210. In the illustrated embodiment of FIG. 2, umbrella pole 182 is threaded through tubular member 110. In the illustrated embodiment of FIG. 2, outdoor chair leg 210 is threaded through first gripping member 132. First securing member 122 is wrapped around tubular member 110 and first gripping member 132 to secure umbrella pole 182 to outdoor chair leg 210. Umbrella pole 182 is secured to outdoor chair leg 210 by first securing member 122 as described above.

Referring to FIG. 3, fastening system 100 is shown as individual pieces comprising tubular member 110, first securing member 122, second securing member 124, first gripping member 132, second gripping member 134, first fastening member 142, and second fastening member 144. In the illustrated embodiment of FIG. 3, first tubular member 110 comprises tightening device 112. In the illustrated embodiment of FIG. 3, first securing member 122 comprises first end 310, second end 312, and releasable lock 314. In the illustrated embodiment of FIG. 3, second securing member 124 comprises first end 320, second end 322, and releasable lock 324. Fastening system 100 is used to secure outdoor chair 160 to the ground as described above (see FIG. 1). Fastening system 100 is used to secure outdoor chair 160 to umbrella pole 182 as described above (see FIG. 1).

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A fastening system for fastening a pole to a sport chair, comprising:

a tubular member;

a securing member to secure the tubular member to a leg of the sport chair; said securing member having a first end, a second end, and a releasable lock disposed on the second end; wherein to lock the securing member, the securing member is wrapped into a circular shape such that the first end meets the second end and the first end is pushed into and through the releasable lock;

a gripping member to prevent the securing member from sliding on the leg of the chair;

a fastening member to pin down the sport chair to the ground; and a tightening member to hold in place the pole when inserted in the tubular member.

2. The fastening system of claim 1, wherein the pole is a fishing pole.

3. The fastening system of claim 1, wherein the gripping member further comprises a non-slick material.

4. The fastening system of claim 1, wherein the pole is an umbrella pole.

* * * * *